US011640141B2

(12) United States Patent
Karapatis et al.

(10) Patent No.: US 11,640,141 B2
(45) Date of Patent: May 2, 2023

(54) TIMEPIECE COMPRISING A TOURBILLON

(71) Applicant: Montres Breguet S.A., L'Abbaye (CH)

(72) Inventors: Polychronis Nakis Karapatis, Premier (CH); Marc Stranczl, Nyon (CH); Benoit Legeret, Ecublens (CH)

(73) Assignee: Montres Breguet S.A., L'Abbaye (CH)

( * ) Notice: Subject to any disclaimer, the term of this patent is extended or adjusted under 35 U.S.C. 154(b) by 975 days.

(21) Appl. No.: 16/410,367

(22) Filed: May 13, 2019

(65) Prior Publication Data

US 2019/0377302 A1 Dec. 12, 2019

(30) Foreign Application Priority Data

Jun. 7, 2018 (EP) ..... 18176488

(51) Int. Cl.
*G04B 17/28* (2006.01)
*G04B 1/22* (2006.01)
(Continued)

(52) U.S. Cl.
CPC ..... *G04B 17/285* (2013.01); *G04B 1/22* (2013.01); *G04B 15/14* (2013.01); *G04B 45/02* (2013.01)

(58) Field of Classification Search
CPC ..... G04B 17/285; G04B 1/22; G04B 15/14; G04B 45/02
(Continued)

(56) References Cited

U.S. PATENT DOCUMENTS 3,630,018 A 12/1971 Nicholas
8,414,184 B2 * 4/2013 Mallet ..... G04B 18/006 368/170
9,292,002 B2 * 3/2016 Di Domenico ..... G04C 3/105
(Continued)

FOREIGN PATENT DOCUMENTS

CH 707 990 A1 10/2014
CH 710 487 A2 6/2016
(Continued)

OTHER PUBLICATIONS

Combined Chinese Office Action and Search Report dated Sep. 25, 2020 in corresponding Chinese Patent Application No. 201910485842.3 (with English Translation and English Translation of Category of Cited Documents) citing document AO therein, 17 pages.
(Continued)

*Primary Examiner* — Edwin A. Leon
*Assistant Examiner* — Kevin Andrew Johnston
(74) *Attorney, Agent, or Firm* — Oblon, McClelland, Maier & Neustadt, L.L.P.

(57) ABSTRACT

The timepiece includes a tourbillon including a carriage that bears a sprung balance and a magnetic escapement device, the latter including an escape wheel set, formed of an annular magnetic structure, and a magnetic element coupled with the magnetic structure and having an oscillating movement that is synchronous with the oscillation of the mechanical resonator. The mechanical escapement is arranged so as to have alternately energy accumulation phases, from a conversion of mechanical energy supplied by the barrel into magnetic potential energy in the magnetic escapement, and transfer phases of energy accumulated in the magnetic escapement to the magnetic resonator. During the energy transfer phases, the magnetic element is subjected to a magnetic force such that the magnetic escapement then converts into mechanical energy magnetic potential energy
(Continued)

accumulated in the preceding energy accumulation phase to be able to maintain the oscillation of the mechanical resonator.

13 Claims, 9 Drawing Sheets

(51) Int. Cl.
*G04B 15/14* (2006.01)
*G04B 45/02* (2006.01)

(58) Field of Classification Search
USPC ..... 368/127
See application file for complete search history.

(56) References Cited

U.S. PATENT DOCUMENTS

2012/0112589 A1* 5/2012 Marechal ..... G04B 31/004 310/90.5
2015/0063083 A1* 3/2015 Kawauchiya ..... G04B 17/285 368/127
2015/0177698 A1* 6/2015 Di Domenico ..... G04C 5/005 368/126
2017/0060091 A1* 3/2017 Heise ..... G04B 17/285
2017/0068222 A1* 3/2017 Di Domenico ..... G04C 5/005
2017/0242403 A1* 8/2017 Di Domenico ..... G04C 5/005
2018/0088531 A1* 3/2018 Mutrux ..... G04B 17/285

FOREIGN PATENT DOCUMENTS

CH 711 402 A2 2/2017
CN 107092179 A 8/2017
EP 0 727 721 A1 8/1996
GB 2533960 A * 7/2016 ..... G04C 3/08
JP 2017-146300 A 8/2017
JP 2018-49013 A 3/2018

OTHER PUBLICATIONS

European Search Report dated Dec. 7, 2018 in European Application 18176488.7 filed on Jun. 7, 2018 (with English translation of categories of Cited Documents).
Notice of the Reason for Refusal dated Aug. 18, 2020 in Japanese Patent Application No. 2019-103549 (with English language translation), citing documents AO and AP therein, 7 pages.

* cited by examiner

TIMEPIECE COMPRISING A TOURBILLON

CROSS-REFERENCE TO RELATED APPLICATION

This application claims priority to European Patent Application No. 18176488.7 filed on Jun. 7, 2018, the entire disclosure of which is hereby incorporated herein by reference.

FIELD OF THE INVENTION

The present invention relates to timepieces comprising a timepiece movement fitted with a tourbillon bearing in a carriage a mechanical resonator, formed of a balance and a balance-spring, and an escapement device. The term tourbillon is also sometimes referred to by those skilled in the art as a karussel. Furthermore, such a timepiece movement comprises a barrel arranged to accumulate mechanical energy and a geartrain kinematically linking the tourbillon carriage to the barrel.

TECHNOLOGICAL BACKGROUND

Timepiece movements fitted with a tourbillon have been known for a long time. The term 'tourbillon' is generally used to refer to such a timepiece movement and even a watch fitted with such a timepiece movement.

In a conventional tourbillon, the carriage functions as a second wheel set. It comprises a second pinion and it is actuated via this second pinion by a medium wheel. The carriage bears a conventional escapement formed of an escape wheel set and a pallet fork, in particular a Swiss lever escapement. The force is transmitted to the escape wheel set via the pinion thereof which meshes, in the manner of a planetary wheel, with a fixed second wheel secured to the plate.

The operation of a conventional Swiss lever escapement is well known to those skilled in the art. The escape wheel has a plurality of teeth which engage with two pallets borne by the pallet fork. Each pallet has at the free end thereof an inclined plane. To generate a sprung balance maintenance impulse, one of the teeth of the escape wheel presses tangentially against the inclined plane of one of the two pallets, so as to exert a force torque on the pallet fork which is thus rotated by the escape wheel, the latter being rotated by the rotation of the carriage via the fixed second wheel. The maintenance impulse ends when the impulse beak, included in each tooth of the escape wheel, is situated at the bottom of the inclined plane. Thus, to generate a maintenance impulse, the escape wheel must be capable of being rotated over an angular distance corresponding to the angular distance, relative to the axis of rotation of the escape wheel set, from the inclined plane of the pallet with which it interacts. However, as stated, the rotation of the escape wheel is intimately linked with that of the tourbillon carriage, a kinematic linkage being provided between the escape wheel and the tourbillon carriage. Consequently, to rotate that escape wheel, it is necessary to set in rotation the tourbillon which has a relatively high inertia. The maintenance impulse transmitted to the balance is therefore limited in intensity by the inertia of the tourbillon and also of the geartrain kinematically linking the tourbillon carriage to the barrel. The inertia of the tourbillon carriage is added to the escape wheel, which increases the inertia thereof.

The tourbillon mechanism is known to average the vertical positions and therefore enhance the working of a timepiece movement in a wristwatch when worn. However, in a conventional movement, the tourbillon increases the inertia of the escapement device as the tourbillon carriage rotates integrally with the escape wheel. This limits the acceleration that may be sustained by the escape wheel. The impulse transmitted to the balance being dependent on the rotation of the escape wheel, it is not possible to increase the frequency above 5 Hz reliably in chronometric terms. As a result, the possible oscillation frequency for the sprung balance of such a tourbillon mechanism is limited. Thus, the oscillation frequency of a conventional sprung balance in a tourbillon is generally less than five Hertz (5 Hz) and may in some specific cases attain 5 Hz. It is usually equal to three Hertz, for example. It is understood that this limits the working accuracy that can be obtained with a timepiece movement fitted with a conventional tourbillon.

Thus, the remarkable advantage of the tourbillon for the working accuracy on wearing a watch incorporating same is impaired, due to conventional escapement operation, by the high inertia generally exhibited by the carriage thereof.

SUMMARY OF THE INVENTION

The aim of the present invention is that of a providing a solution to the problem of the conventional tourbillon mentioned above, so as to help increase the chronometric benefit of a tourbillon, in particular increasing the working accuracy of the timepiece movement fitted with a tourbillon according to the invention by the arrangement of a mechanical resonator in the tourbillon carriage, having an oscillation frequency Fo greater than conventional frequencies, preferably greater than five Hertz (Fo>5 Hz).

The invention therefore concerns a timepiece comprising a timepiece movement fitted with a tourbillon, that comprises a carriage arranged rotating about a main axis, a barrel, arranged to accumulate mechanical energy, and a geartrain kinematically linking the tourbillon carriage to the barrel. The tourbillon bears a mechanical resonator, formed of a balance and a balance-spring, and an escapement device. According to the invention, the escapement device is a magnetic escapement that comprises an escape wheel set formed of an escape pinion and a magnetic structure or magnetic structures having a general annular shape centred on an axis of rotation of the escape wheel set. The magnetic escapement further comprising a magnetic element that, or a plurality of magnetic elements each whereof is arranged so as to have an oscillating movement that is synchronous with the oscillation of the mechanical resonator and that has a radial component different to zero relative to said axis of rotation. The magnetic element or each of the magnetic elements of the plurality of magnetic elements is coupled, at least momentarily periodically, with the magnetic structure or the magnetic structures such that the escape wheel set rotates by a predetermined angular period at each oscillation period of the balance. Then, according to the invention, the magnetic escapement has, in normal timepiece movement operation, alternately energy accumulation phases, from a conversion of mechanical energy supplied by the barrel into magnetic potential energy in the magnetic escapement, and transfer phases of energy accumulated in the magnetic escapement to the magnetic resonator.

Finally, the magnetic escapement is arranged such that:

during each energy accumulation phase, the magnetic element or the set of magnetic elements, that of the plurality of magnetic elements are then coupled with the magnetic structure or the magnetic structures, is subjected to a magnetic force torque, relative to said axis of rotation, having an opposite direction to that of a drive torque, applied by the barrel via the tourbillon carriage to the escape wheel set, and an intensity less than that of this drive force torque, such that the escape wheel set is suitable for rotating by a certain angle to enable the accumulation of a certain magnetic potential energy in the magnetic escapement;

during each energy transfer phase, the magnetic element or each element of the set of magnetic elements, that of the plurality of magnetic elements is coupled with the magnetic structure or the magnetic structures during a preceding energy accumulation phase, is subjected to a (preferably main) radial magnetic force, relative to said axis of rotation, during an alternation of the oscillating movement thereof and in the direction of the radial component of this oscillating movement during this alternation, such that the magnetic escapement converts into mechanical energy magnetic potential energy accumulated (preferably the most part) in the preceding energy accumulation phase to be able to maintain the oscillation of the mechanical resonator.

Owing to the features of the timepiece according to the invention, in particular to the type of magnetic escapement selected to equip the tourbillon, the energy impulses transmitted to the mechanical resonator to maintain same are not limited in intensity by the inertia of the tourbillon carriage. In fact, even the inertia of the geartrain no longer influences the generation of these energy impulses. Indeed, only the inertia of the pallet fork (in the event of a stopper being envisaged) influences the dynamics of the maintenance impulses supplied by the magnetic escapement to the mechanical resonator. It shall be noted that the pallet fork forms herein a magneto-magnetic converter. Thus, these maintenance impulses may be briefer, i.e. occur in very limited time intervals which are no longer dependent on the inertia of the tourbillon. These remarkable features help enhance the working accuracy of the timepiece movement and in particular enhance the isochronism of the mechanical resonators formed by a sprung balance. Furthermore, they make it possible to arrange in the tourbillon mechanical resonators having a high quality factor, in particular a sprung balance having a much higher natural oscillation frequency than that of a usual sprung balance for a conventional tourbillon, in particular a natural frequency greater than 5 Hz.

The magnetic escapement according to the present invention therefore makes it possible to temporally dissociate the periodic transmission of a certain quantity of energy from the barrel to the magnetic escapement, which is arranged to accumulate same momentarily, and the transmission of this accumulated energy from the magnetic escapement to the mechanical resonator.

Thus, owing to the magnetic escapement as selected within the scope of the invention to equip a tourbillon, the maintenance impulses supplied by the magnetic escapement to the mechanical resonator may be generated essentially without rotation of the escape wheel and substantially independently of such a rotation. Thus, the inertia of the geartrain and the inertia of the tourbillon carriage no longer impede the generation of the maintenance impulses. What is important is the radial nature of the force arising essentially to generate each maintenance impulse after a magnetic potential energy accumulation phase in the magnetic escapement, such that the fact that the carriage rotates or not or merely by a small angle has substantially no impact on the generation of the maintenance impulses. For this reason, the tourbillon mechanism fitted with a magnetic escapement according to the invention can deliver maintenance impulses of short duration and of relatively high intensity.

In one advantageous embodiment, the mechanical resonator comprises a balance which is pivoted magnetically in the tourbillon carriage, which comprises for this purpose two magnetic bearings. This particular variant makes it possible, in addition to the various advantages provided by the magnetic escapement selected, to significantly limit differences in working of the mechanical resonator between the horizontal positions and the vertical positions (the latter being averaged by means of the tourbillon). It is therefore understood that it thus becomes possible to obtain a tourbillon watch having a very high working accuracy.

BRIEF DESCRIPTION OF THE FIGURES

The invention will be described in more detail below with reference to the annexed drawings, given by way of non-limiting examples, and in which.

DETAILED DESCRIPTION OF THE INVENTION

Figure 1:
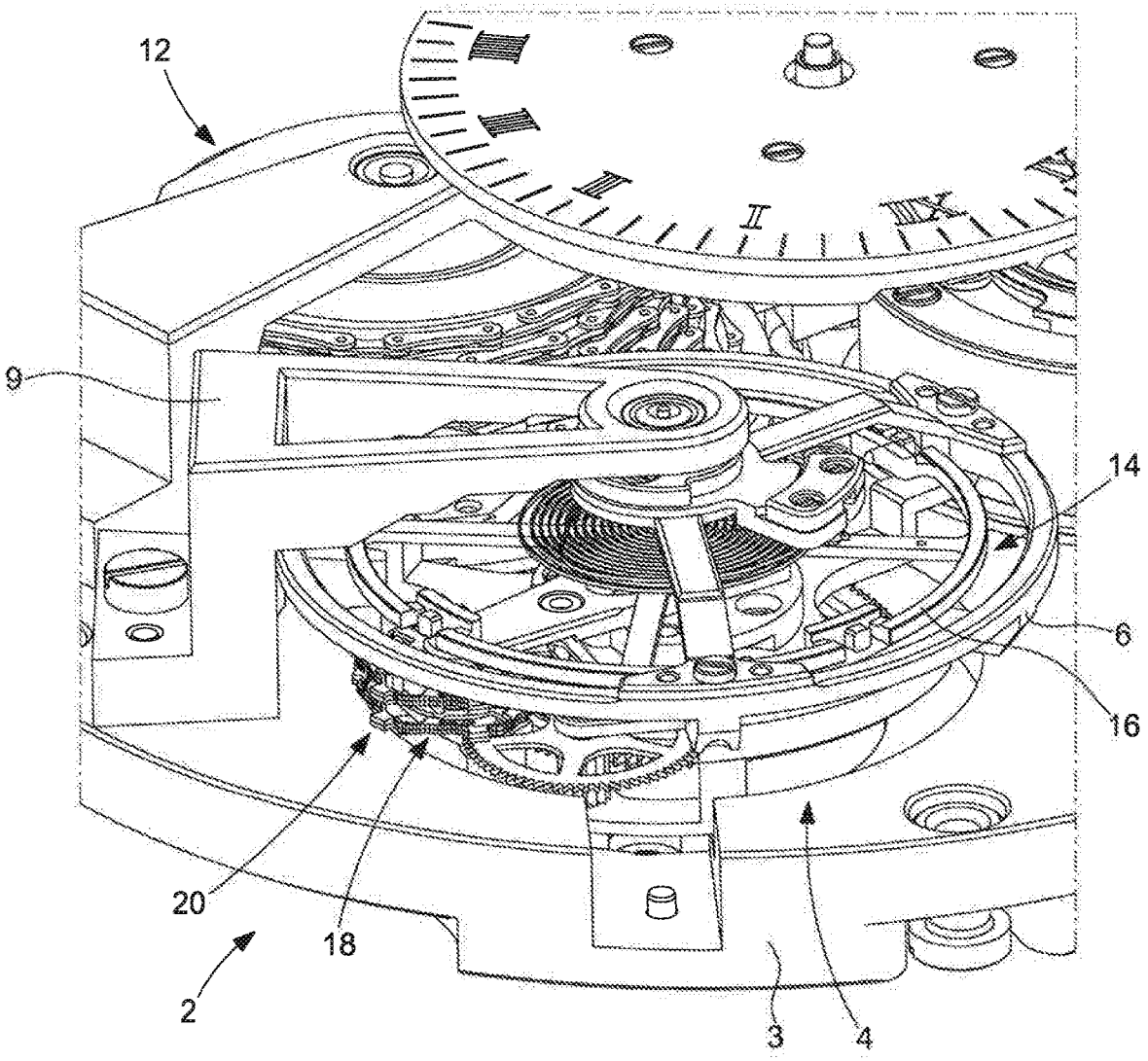
FIG. 1 is a partial perspective view of a first embodiment of a timepiece according to the invention, which is formed by a movement fitted with a tourbillon.
Figure 2:
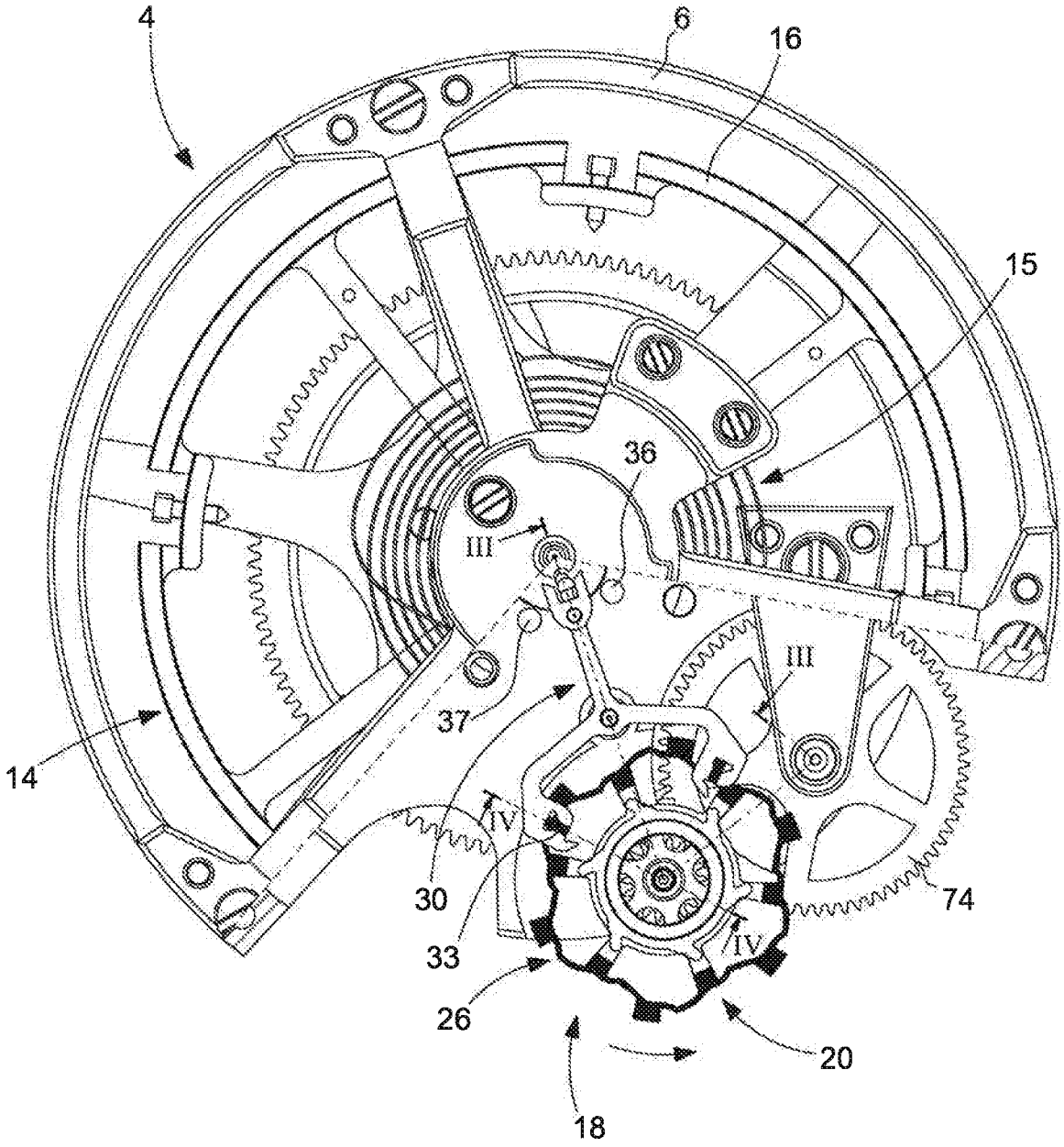
FIG. 2 is a partial top view of the timepiece movement of FIG. 1 with some elements removed to facilitate the view of important elements for the invention.

With reference to FIGS. 1 to 11, there will be described a first embodiment of the invention and in particular the specific operation of the magnetic escapement incorporated in the tourbillon according to the invention.

The timepiece comprises a timepiece movement 2 fitted with a tourbillon 4 comprising a carriage 6 arranged rotating about a main axis 8, a barrel 10 arranged to accumulate mechanical energy and a geartrain 11 kinematically linking the tourbillon carriage to the barrel. The tourbillon bears a mechanical resonator 14, formed of a balance 16 and a balance-spring 15, and an escapement device 18. The tourbillon is pivoted between a bottom plate 3 and a bridge 9. The escapement device consists of a magnetic escapement that comprises an escape wheel set 20 formed of an escape pinion 24 and a first escape wheel 22, the latter comprising a first magnetic structure 26 having a general annular shape and centred on an axis of rotation 28 of the escape wheel set.

The magnetic escapement comprises a stopper 30 coupling momentarily, in each oscillation alternation of mechanical resonator 14, this mechanical resonator with escape wheel set 20. This stopper and the escape wheel set are pivoted between a portion of carriage 6 and an escape bridge 19 borne by this carriage. The stopper is subjected, when the mechanical resonator oscillates, to a to-and-fro movement interspersed with rest phases wherein the stopper is alternately stopped in two rest positions where it respectively abuts against two pins 36 and 37.

In the variant shown, the stopper is formed by a pallet fork bearing two magnetic elements 32 and 33 each arranged so as to have an oscillating movement that is synchronous with the oscillation of the mechanical resonator and that is oriented essentially along a radial direction relative to axis of rotation 28 of the pallet fork. The two magnetic elements are similar and situated on the same side of escape wheel 22. They are both coupled simultaneously in a similar manner to the first magnetic structure, which is arranged such that these two magnetic elements are coupled therewith continuously (or quasi-continuously) and such that the respective magnetic couplings thereof are added together. The operation of this magnetic escapement will be described in more detail hereinafter.

In the variant shown, escape wheel set 20 comprises a second wheel 38 comprising a second magnetic structure 40 that has a planar symmetry with the first magnetic structure 26 and that is situated at a distance therefrom so as to enable the two magnetic elements 32 and 33 to be situated, when they oscillate, at least momentarily between the first and second magnetic structures. The two magnetic elements 32 and 33 interact, similarly, simultaneously with the first and second magnetic structures, such that the effects are added together. The two magnetic elements are coupled with the first and second magnetic structures such that the escape wheel set rotates by a predetermined angular period at each oscillation period of the balance 16. The first and second magnetic structures and are formed respectively of a first permanent magnet and a second permanent magnet that each have an axial magnetisation and the same polarity. The two magnetic elements of the pallet fork are each formed of a permanent magnet having an axial magnetisation and an inverted polarity relative to the first and second magnets, so as to be subject to a magnetic repulsion force with each of the two magnetic structures.

Preferably, first and second wheels 22 and 38 bear respectively a first ferromagnetic structure 44 and a second ferromagnetic structure 46 covering respectively the first and second magnetic structures on both external sides of the set consisting of these first and second magnetic structures, so as to form in association with some fastening pins (see FIG. 3) rising from each of the two ferromagnetic structures, a certain shield of the first and second magnetic structures and of each magnetic element situated therebetween and thus magnetically coupled therewith. The two ferromagnetic structures form respectively two supports for the two magnetic structures. In the variant shown, since the two magnetic elements are continuously coupled with the first and second magnetic structures and therefore remain situated between the two ferromagnetic structures, the magnetic escapement is partially shielded. Furthermore, the magnetic fields of the magnetic structures and of the magnetic elements are confined by the first and second ferromagnetic structures.

As a general rule, the magnetic escapement is arranged so as to have, in normal timepiece movement operation, alternately energy accumulation phases, from a conversion of mechanical energy supplied by the barrel into magnetic potential energy in the magnetic escapement, and transfer phases of energy accumulated in the magnetic escapement to the magnetic resonator. Each energy accumulation phase and subsequent energy transfer phase occur during a time interval equal to half an oscillation period of the mechanical resonator.

Figure 5:
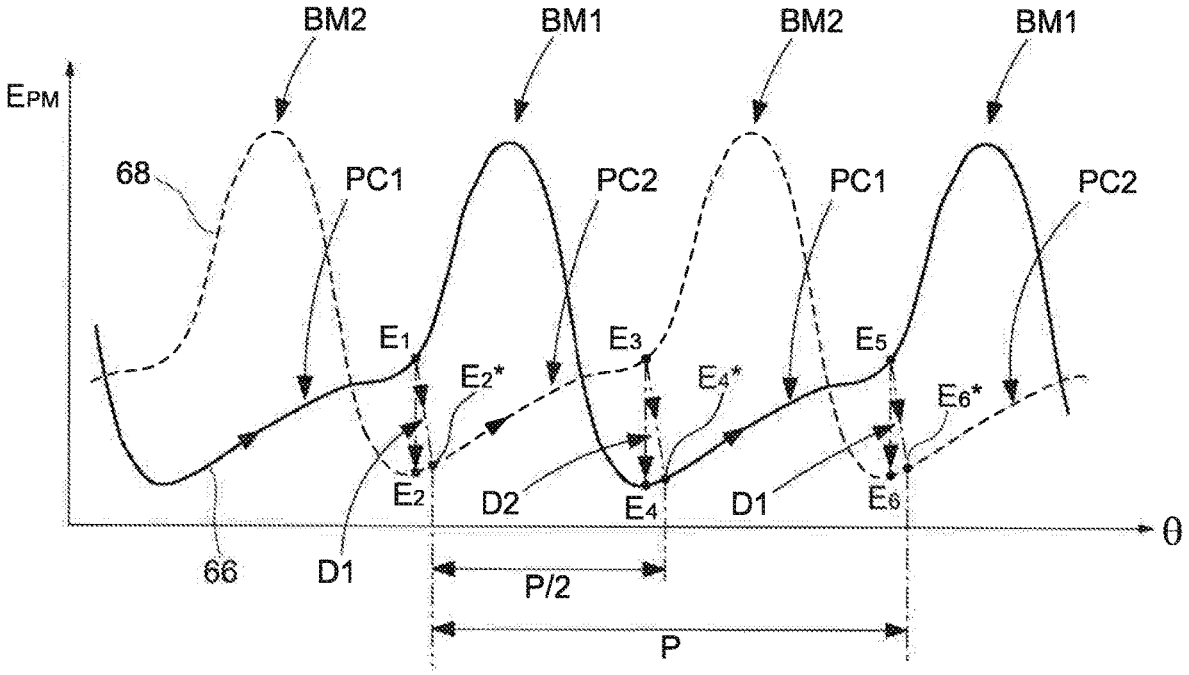
FIG. 5 gives the two curves of the magnetic potential energy in the magnetic escapement of FIG. 2, as a function of the angular position of the escape wheel set, for the stopper positioned respectively in either of the rest positions thereof.
Figure 6:
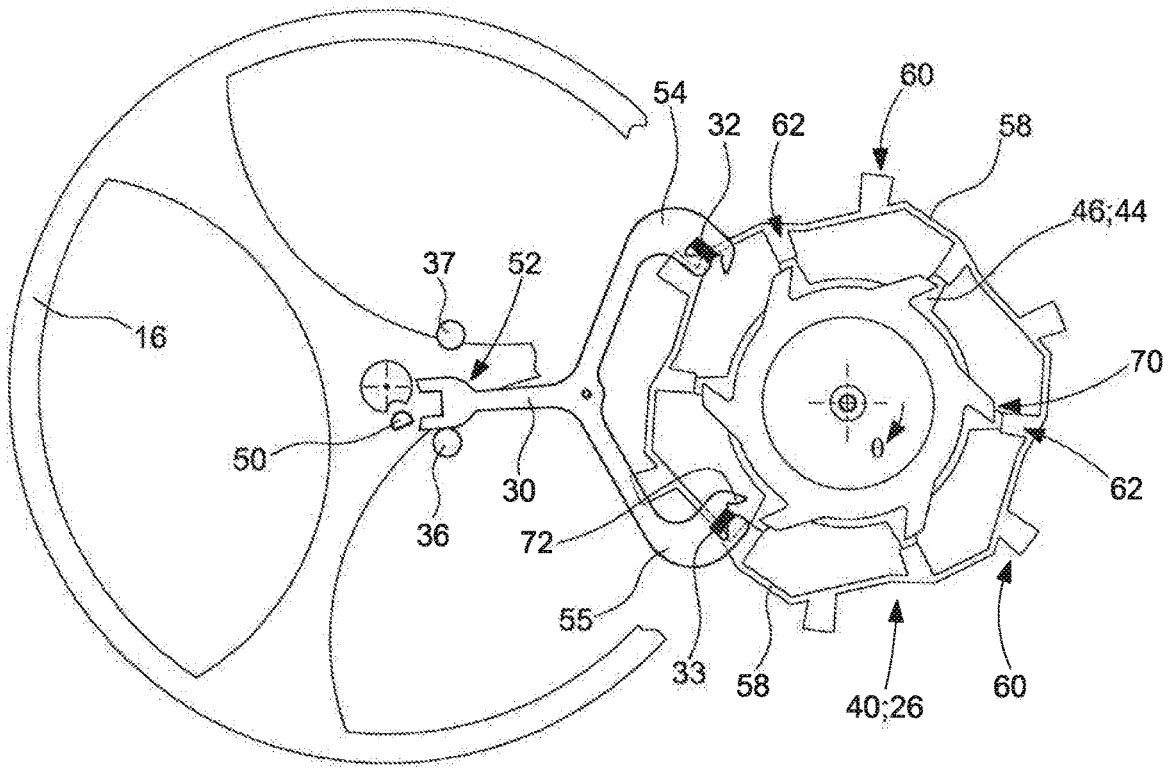
FIGS. 6 to 9 represent partially the mechanical resonator and the magnetic escapement, incorporated in the tourbillon of the first embodiment, in four different positions during an alternation of the mechanical resonator.
Figure 7:
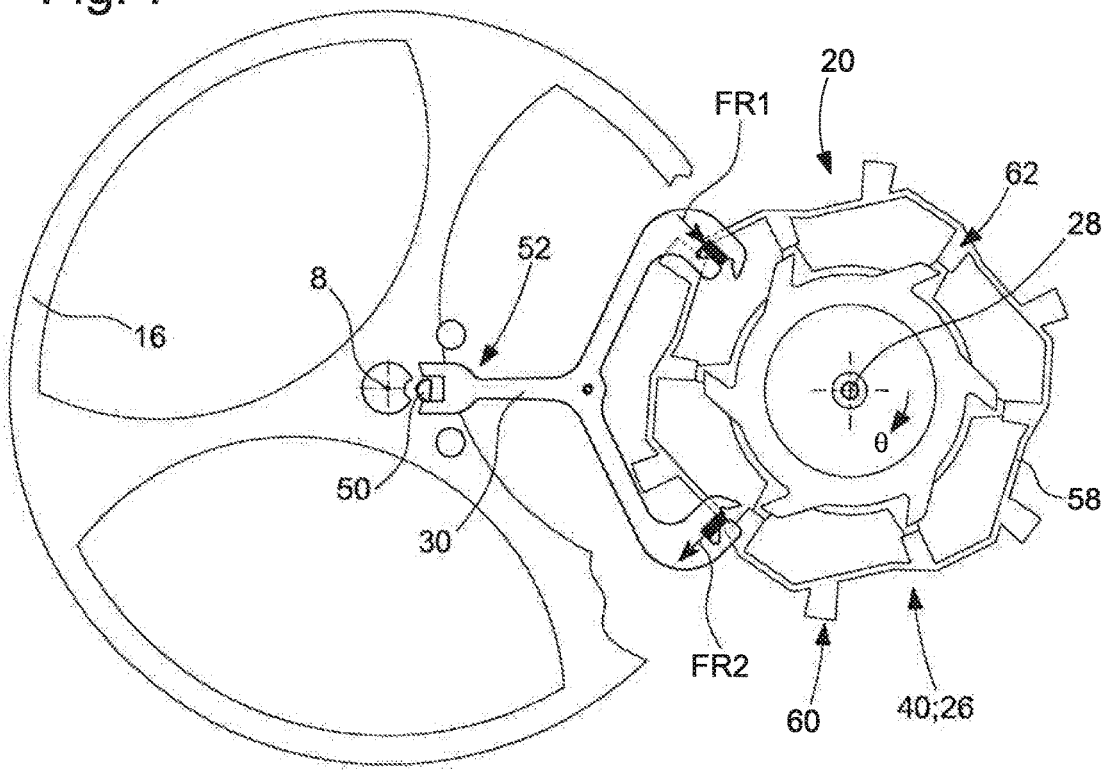

Within the scope of the first embodiment, the arrangement of the magnetic escapement mentioned in the preceding paragraph and the operation of this magnetic escapement will be described hereinafter with reference to FIGS. 5 to 9. FIG. 5 shows two magnetic potential energy curves 66 and 68, respectively for the two rest positions of pallet fork 30 where the latter respectively presses against stops 36 and 37, each corresponding to magnetic potential energy $E_{PM}$ in the magnetic escapement as a function of angle θ giving the angular position of escape wheel set 20 and therefore magnetic structures 26 and 40 (it will be noted that this angle θ is measured according to the direction of rotation of the escape wheel set, i.e. the clockwise direction in the example shown in FIGS. 6 to 9). A magnetic escapement of the type selected for the first embodiment of the invention is disclosed in patent application EP 3 208 667 A1. There will be described the operation thereof and the particular features of this operation used within the scope of the present invention. FIGS. 6 to 9 show four successive moments of an alternation of balance 16 and of an alternation (i.e. a half-cycle) of pallet fork 30 coupled momentarily with this balance.

Firstly, the two magnetic structures 26 and 40 define together, in each of the two rest positions of pallet fork 30, increasing magnetic potential energy portions PC1, respectively PC2 for magnetic elements 32 and 33 of pallet fork 30 that are both coupled, herein continuously, with the two magnetic structures. In the variant described, these increasing portions are defined substantially by a magnetic track 58 comprised in each of the two magnetic structures 26 and 40, this magnetic track having a particular outline, alternately re-entering and exiting relative to a median geometric circle. During normal timepiece movement operation, this particular outline is suitable for magnetic potential energy accumulation on a rotation of the escape wheel set over a certain magnetic distance, while the pallet fork is alternately in both rest positions thereof. Each magnetic track 58 is formed by the permanent magnet constituting the corresponding magnetic structure, this permanent magnet being arranged in magnetic repulsion with the permanent magnets constituting both magnetic elements 32 and 33, as previously described.

Figure 8:
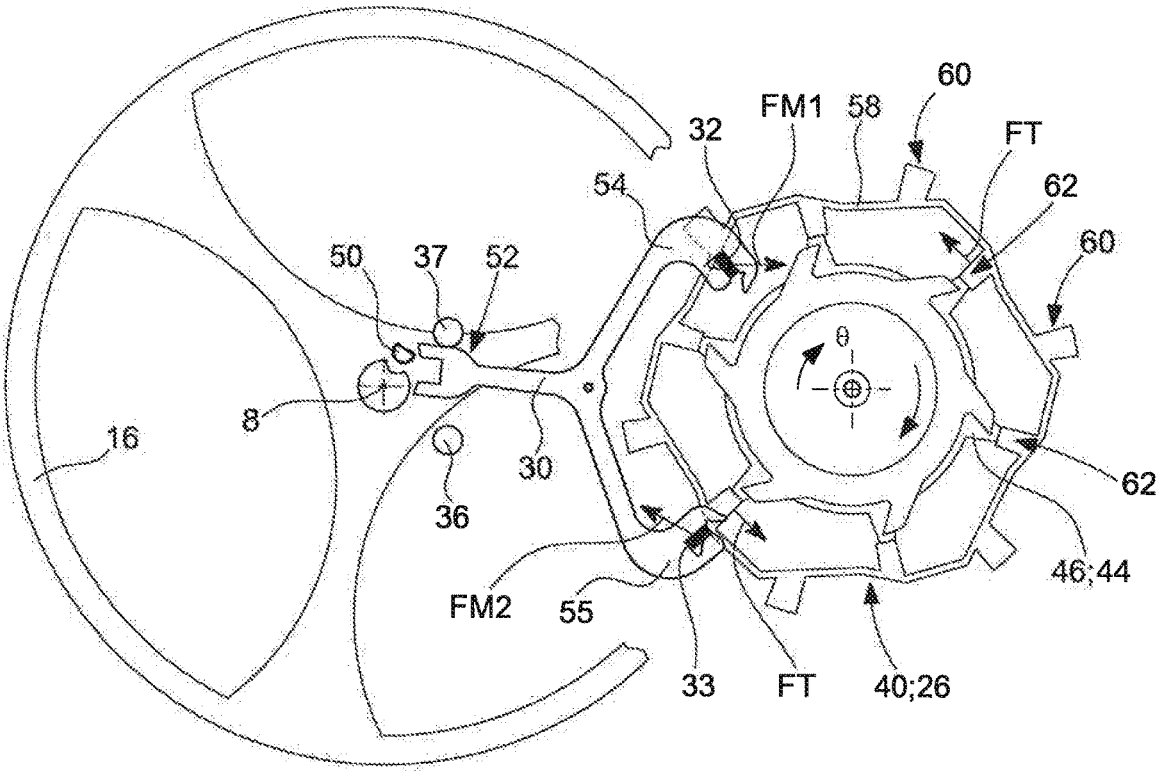
Figure 9:
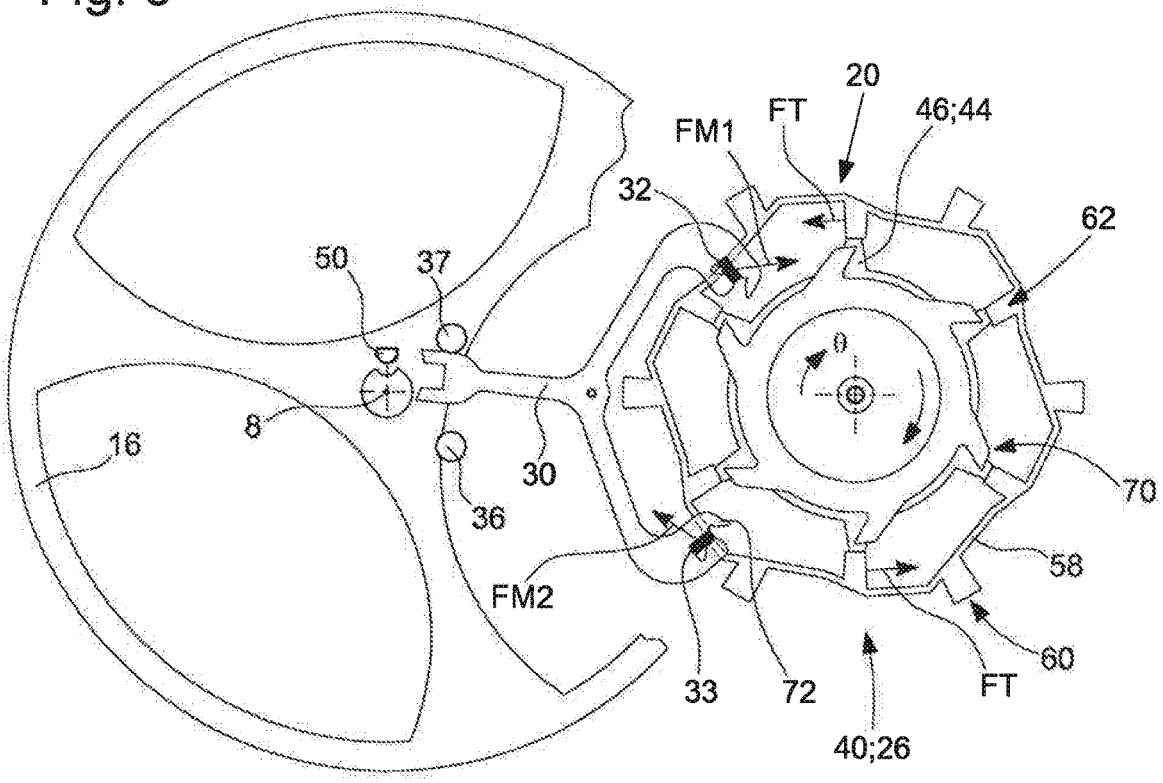

Increasing portions PC1 and PC2 thus define magnetic potential energy accumulation gradients in the magnetic escapement. During each energy accumulation phase, the two magnetic structures 26, 40 and therefore the escape wheel set are subjected to a magnetic force torque (represented schematically in FIGS. 8 and 9 by two tangential arrows FT) having an opposite direction to the direction of rotation of the escape wheel set (given in these figures by a circular arrow), i.e. opposite a drive torque applied by the barrel via the tourbillon carriage to the escape wheel set, and an intensity less than that of this drive torque, such that the escape wheel set rotates by a certain angle to enable the accumulation of a certain magnetic potential energy in the magnetic escapement. It will be noted that the two magnetic elements 32 and 33 are subjected, in response, each to a magnetic force FM1, respectively FM2 having, on one hand, a tangential component different to zero relative to the axis of rotation of the escape wheel set (i.e. a component tangent at all points to a geometric circle centred in the axis of rotation 28). Furthermore, these magnetic forces FM1 and FM2 are oriented such that the pallet fork is also subjected to a magnetic force torque, which keeps fork 52 pressing against stop pin 36, respectively 37 depending on whether the pallet fork is in either of the two rest positions thereof in the energy accumulation phase in question. In FIG. 8, which shows a status of the magnetic escapement substantially at the start of an energy accumulation phase, magnetic forces FM1 and FM2 are oriented such that the magnetic force torque applied to the pallet fork is greater than the magnetic force torque applied to this pallet fork at the end of an energy accumulation phase (status corresponding to that of FIG. 6, but already visible in FIG. 9 showing an intermediate status of the magnetic escapement during an energy accumulation phase).

During each energy accumulation phase, it can be said that the two magnetic elements 32 and 33 of the pallet fork, that are coupled with both magnetic structures 26 and 40, climb together one of the angular magnetic potential energy accumulation gradients PC1 respectively PC2, by a certain rotation of the escape wheel set, while pallet fork 30 is in a rest phase. However, it will be noted that this consists of magnetic interaction energy such that it is the assembly of 'magnetic structures and magnetic elements' that climbs the angular magnetic potential energy gradients. In the case of a coordinate reference associated with the timepiece movement, it is in fact rather the escape wheel set that climbs increasing portions PC1 and PC2 of potential energy curves 66 and 68, since it rotates while the magnetic elements are immobile. Nevertheless, if a coordinate reference associated with the escape wheel set and fixed in relation thereto is considered, then it is these two magnetic elements that climb the increasing portions. It is understood therefore that this is equivalent.

In FIG. 5, it is seen that the magnetic escapement is arranged such that increasing portions PC1 of first magnetic potential energy curve 66 are respectively offset by an angular half-period P/2 relative to increasing portions PC2 of second magnetic potential energy curve 68. Then the two magnetic structures define for the two magnetic elements 32 and 33, in each of the two rest positions of the pallet fork, magnetic barriers BM1, respectively BM2 following increasing portions PC1, respectively PC2. Magnetic barriers BM1 and BM2 of a magnetic potential energy curve 66, 68 are formed respectively by magnetised areas 60 and 62 situated alternately on either side of magnetised track 58. Each magnetic barrier BM1 is thus situated angularly between two successive magnetic barriers BM2 (and therefore conversely).

More specifically, in the variant described, two successive magnetic barriers BM1 or BM2 are offset angularly by an angular period P. Both magnetic elements of the pallet fork are offset angularly, relative to axis of rotation 28, substantially by an angle equal to 3P/2 (generally an odd number of half-periods P/2). In each of the two rest positions of the pallet fork, when one of the two magnetic elements is coupled with an exiting part of track 58, the other is coupled with a re-entering part of this track. Then, when the first magnetic element is presented in front of an outer magnetised area 60, the second is presented in front of an inner magnetised area 62, and conversely.

During normal timepiece movement operation, the magnetic barriers are arranged so as to generate, on the two magnetic elements having climbed a preceding angular gradient, a relatively high magnetic force torque opposing the drive torque applied by the barrel to the escape wheel set, to be able to thus stop the angular progress of the escape wheel set. For a given mechanical force torque, the escape wheel set finally stops at a substantially determined angular position (status corresponding to FIG. 6), corresponding in FIG. 5 to stable points $E_1$, $E_3$, $E_{2N+1}$, where N>0, alternately on curves 66 and 68. It will be noted that slight rebounds may occur such that the escape wheel set is subjected to a certain oscillation about these stable points, which is dampened relatively quickly under the action of usual timepiece wheel set friction. In a preferred variant, timepiece movement 2 comprises a fusee 12 for equalising the force torque supplied by barrel 10 to tourbillon carriage 6, such that the escape wheel set is subjected to a substantially constant torque in the useful operating range of the timepiece. Thus, throughout this operating range, the abovementioned stable points correspond to a potential magnetic energy of the same value.

Then, during each energy transfer phase, both magnetic elements 32 and 33 are each subjected to a radial magnetic force FR1 and FR2 (status corresponding to FIG. 7), relative to axis of rotation 28 of the escape wheel set, during an alternation of the oscillating movement thereof and in the direction of this oscillating movement during this alternation. It will be noted that this radial magnetic force is generally a radial component of the total magnetic force applied on each of the magnetic elements. It will be noted that the oscillating movement of the magnetic elements is, in the preferred variant shown, substantially radial relative to axis of rotation 28 of the escape wheel set and therefore of magnetic structures 26 and 40 which are overall centred on this axis of rotation. The axis of rotation of the pallet fork is positioned for this purpose in the timepiece movement. The magnetic forces, acting respectively on the magnetic elements of the pallet fork, that supply mechanical energy to this pallet fork, in the form of work of a magnetic force torque, are therefore herein substantially radial components FR1, FR2, also known as radial magnetic forces, of the respective total magnetic forces.

As in a conventional Swiss lever escapement, each alternation of the pallet fork 30 starts with an initial driving of this pallet fork by the balance via an impulse pin 50 (pin having a truncated disk profile) which is placed between the two horns of fork 52 of the pallet fork. This initial phase enables magnetic elements 32 and 33 to each be subjected to an initial radial movement before they are subjected, in a subsequent phase of the alternation in question of the oscillating movement thereof, to a drop in magnetic potential energy such that the magnetic escapement is subjected overall to a decrease in magnetic potential energy, referenced D1 and D2 in FIG. 5, during each alternation of the oscillation of the balance 16 and hence each alternation of the oscillating movement of the pallet fork 30. During such an alternation, the pallet fork moves from one rest position to the other such that the magnetic potential energy in the magnetic escapement varies switching from a status described by curve 66 to a status described by curve 68 or conversely, according to whether the pallet fork is initially in one or the other of the two rest positions thereof at the start of the alternation in question.

The arrangement of the magnetic escapement described above, from which results the profile of each of the two curves 66 and 68, therefore enables this magnetic escapement to convert into mechanical energy magnetic potential energy accumulated in the preceding energy accumulation phase so supply same to the pallet fork in the form of a force torque working while the pallet fork rotates. Thus, the pallet fork becomes driving and supplies an energy impulse to the balance via fork 50 thereof, as in a conventional mechanical escapement, to maintain the oscillation of the sprung balance. The magnetic escapement selected within the scope of the invention is remarkable in that the energy transfer can occur without any rotation of the escape wheel set, as shown in FIG. 5 for the particular variant wherein the escape wheel set remains at an angular position during each alternation of the pallet fork, the magnetic potential energy at the end of alternation corresponding to points $E_2$, $E_4$, $E_{2N}$ where N>0, alternately on curves 68 and 66. It will be noted that according to the drive torque of the barrel, the inertia of the tourbillon carriage and the specific arrangement of the magnetic structures, the escape wheel set may be subjected to a small rotation during alternations of the pallet fork, particularly in the end phase thereof. Such a variant is also shown in FIG. 5 where the magnetic escapement is located at the end of alternation at points $E_2$*, $E_4$*, $E_{2N}$* where N>0. The important feature for the type of magnetic escapement selected is not that the escape wheel rotates or does not rotate during the transmission of an energy impulse to the mechanical resonator, but that a certain angular movement thereof is not required to trigger this energy impulse, once the balance is coupled mechanically with the pallet fork via the fork thereof, and to generate same entirely, such that the intensity thereof is not dependent on the inertia of the elements between the barrel and the escape wheel set, in particular not on the inertia of the tourbillon carriage.

It will be noted that the magnetic escapement selected within the scope of the first embodiment is substantially at constant force; i.e. the decreases in magnetic potential energy in the energy transmission phases to the balance remain substantially constant in the useful operating range of the timepiece. This is a property of the magnetic system of the magnetic escapement selected (see FIG. 5). Indeed, even in the absence of a device for equalising the force torque applied to the escape wheel set by the barrel, the maintenance impulses supplied to the mechanical resonator in said useful operating range (force torques applied by the barrel to the escape wheel set varying in a given range of values) correspond respectively to quantities of energy having similar values. The fusee 12 for equalising the force torque supplied by the barrel to the tourbillon carriage/escape wheel set therefore serves herein to enhance the efficiency of the entire system (timepiece movement).

As a general rule, within the scope of the first embodiment, the selected magnetic escapement comprises stopper coupling momentarily, in each oscillation alternation of the mechanical resonator, this mechanical resonator with the escape wheel set, the stopper bearing a magnetic element or a plurality of magnetic elements and being subjected when the mechanical resonator oscillates, to a to-and-fro movement interspersed with rest phases wherein the stopper is alternately stopped in two rest positions. A magnetic structure or plurality of magnetic structures define in the two rest positions of the stopper respectively a first magnetic potential energy curve and a second magnetic potential energy curve, both as a function of the angle of the escape wheel set and each having:

increasing portions for the magnetic interaction between the magnetic structure or magnetic structures and said magnetic element or set of magnetic elements that, of the plurality of magnetic elements, are coupled with the magnetic structure, respectively with the magnetic structures in the corresponding rest position of the stopper, these increasing portions being configured so as to be suitable for being climbed cyclically and periodically, during normal timepiece movement operation, by this magnetic element by this set of magnetic elements, and magnetic barriers following respectively the increasing portions, these magnetic barriers being arranged so as to be suitable for stopping angular progress of the escape wheel set while the stopper is in the corresponding rest position.

Then, the increasing portions of the first magnetic potential energy curve are respectively offset angularly relative to the increasing portions of the second magnetic potential energy curve, each magnetic barrier of one of the first and second magnetic potential energy curves being situated angularly between two successive magnetic barriers of the other of these first and second magnetic potential energy curves.

Furthermore, the magnetic escapement is arranged such that:

the energy accumulation phases occur essentially and respectively in the successive rest phases of the stopper, during each energy accumulation phase, said magnetic element or the set of magnetic elements, which of the plurality of magnetic elements are at that time coupled with the magnetic structure or with the magnetic structures, is suitable for climbing at least partially one of the increasing portions during a certain rotation of the escape wheel set, the increasing portions of the first and second magnetic potential energy curves may, during normal timepiece movement operation, be respectively and alternately climbed at least partially during successive energy accumulation phases.

Finally, the magnetic escapement is further arranged such that:

the energy transfer phases occur respectively in successive alternations of the to-and-fro movement of the stopper, this magnetic escapement is subjected, during normal timepiece movement operation, overall to a decrease in magnetic potential energy during each of the successive alternations of the to-and-fro movement of the stopper, and the decrease in magnetic potential energy in the magnetic escapement results essentially from work of the radial magnetic force applied on said magnetic element or on each magnetic element of the set of magnetic elements that, of the plurality of magnetic elements, were coupled with the magnetic structure or with the magnetic structures during a preceding rest phase, this work of the radial magnetic force thus being supplied to the stopper that is arranged to transmit same mostly to the mechanical resonator, such that this mechanical resonator can receive a mechanical energy impulse in each alternation of the to-and-fro movement of this stopper.

The variant of the first embodiment represented comprises six outer magnetised areas 60 forming as many magnetic stops to momentarily stop the escape wheel and also six inner magnetised areas 62 also forming as many magnetic stops. It will be noted that the number of outer/inner magnetised areas may be different and preferably greater. Thus, in a further variant, the number of outer/inner magnetised areas is equal to ten or twelve. It will further be noted that, in another variant, it is envisaged to have only inner magnetised areas or, preferably, only outer magnetised areas.

In an advantageous variant, represented in FIGS. 2 and 6 to 9, a safety mechanism is envisaged in the event of shocks or other high accelerations liable to be sustained by the magnetic escapement. It is obtained by teeth 70 secured to the escape wheel set arranged at the arms 54 and 55 of the pallet fork bearing respectively both magnets 32 and 33, these teeth being suitable for engaging with two fingers situated respectively at the ends of both arms. In each rest position of the pallet fork, if the magnetic barrier described above does not exert a sufficient stopping torque to prevent the escape wheel set from not traversing same, one of the two fingers then comes to a stop against one of the teeth 70.

As the invention makes it possible to increase the oscillation frequency of the sprung balance, even considerably, it is envisaged for this purpose, particularly to maintain the angular speed of the tourbillon carriage at one revolution per minute, that the tourbillon bears an intermediate wheel set 74 of which intermediate wheel 76 meshes with escape pinion 24 and intermediate pinion 78 meshes with fixed second wheel 80 comprised by the timepiece movement. The intermediate wheel set is a reducer wheel set of the rotational frequency of the escape wheel set and is herein arranged such that the tourbillon carriage performs one revolution on itself per minute. In an advantageous variant, the oscillation frequency Fo of the mechanical resonator is greater than five Hertz (Fo>5 Hz). In a preferred variant, this frequency is substantially equal to or greater than 6 Hz (Fo>=6 Hz) and, in a specific variant, the oscillation frequency of the mechanical resonator has a value situated between, inclusive, eight Hertz and twelve Hertz (8 Hz=<Fo=<12 Hz). It will be noted that an intermediate wheel set is already useful for lower sprung balance oscillation frequencies, for example for three Hertz (Fo=3 Hz), as the escape wheel set performs in the example shown one revolution per six sprung balance oscillation periods, which corresponds to a rotational frequency much greater than that of a conventional toothed escape wheel.

Rotational frequency $F_{Rot}$ of the escape wheel is determined by the frequency of mechanical resonator Fo and by the number of outer magnetised areas 60, respectively the number of inner magnetised areas 62. In a general variant, rotational frequency $F_{Rot}$ (number of revolutions per second) of the escape wheel set is between, inclusive, one quarter and one sixteenth of oscillation frequency Fo of the mechanical resonator ($Fo/16=<F_{Rot}=<Fo/4$). This means that the number $N_{PA}$ of outer 60 or inner 62 magnetised areas/magnetic stops is between four and sixteen ($4<=N_{PA}<=16$), since $F_{Rot}=FO/N_{PA}$. In a first example with a mechanical resonator oscillating at three Hertz (Fo=3 Hz) and the toothing of fixed wheel (80) comprising 108 teeth, the intermediate pinion comprises 70 teeth, while escape pinion (24) comprises 18 teeth. In a second example with a mechanical resonator oscillating at six Hertz (Fo=6 Hz) and the toothing of the fixed wheel comprising 120 teeth, the intermediate pinion comprises 12 teeth and the intermediate wheel comprises 72 teeth, while the escape pinion comprises 12 teeth.

Figure 3:
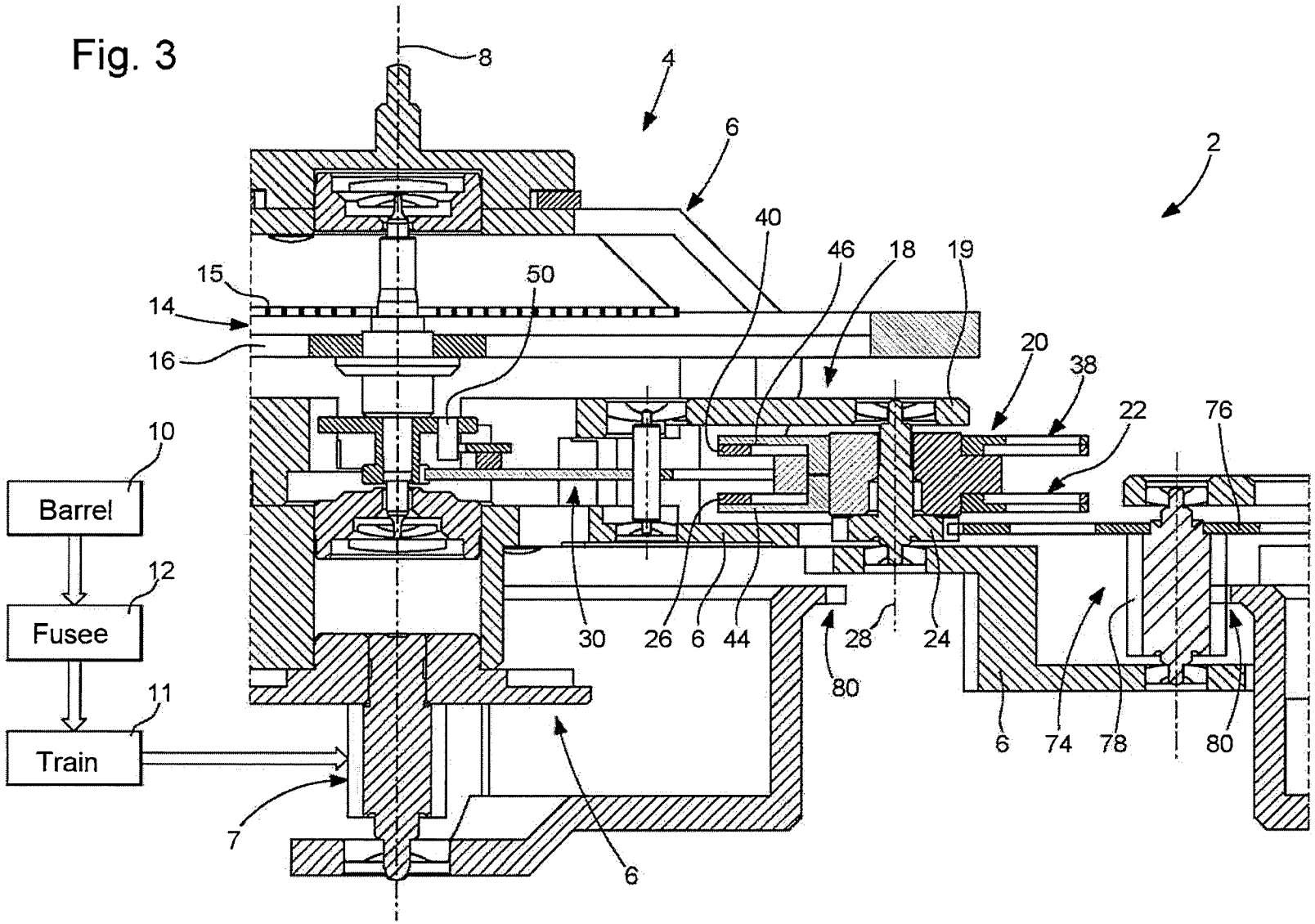
FIG. 3 is a cross-section of the timepiece movement of FIG. 1, along the cross-section line III-III indicated in FIG. 2.
Figure 4:
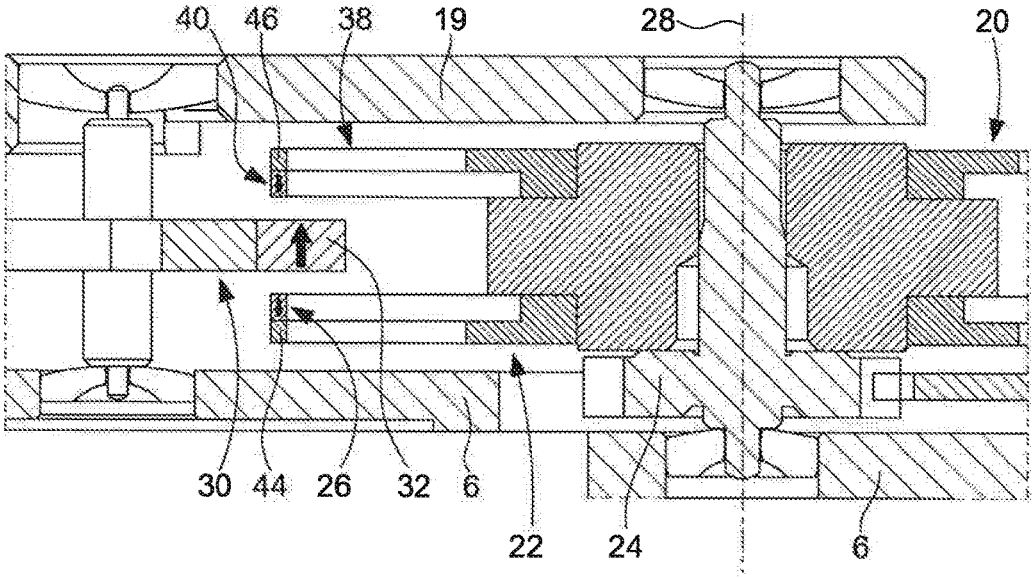
FIG. 4 is a cross-section of the timepiece movement of FIG. 1, along the cross-section line IV-IV indicated in FIG. 2.
Figure 10:
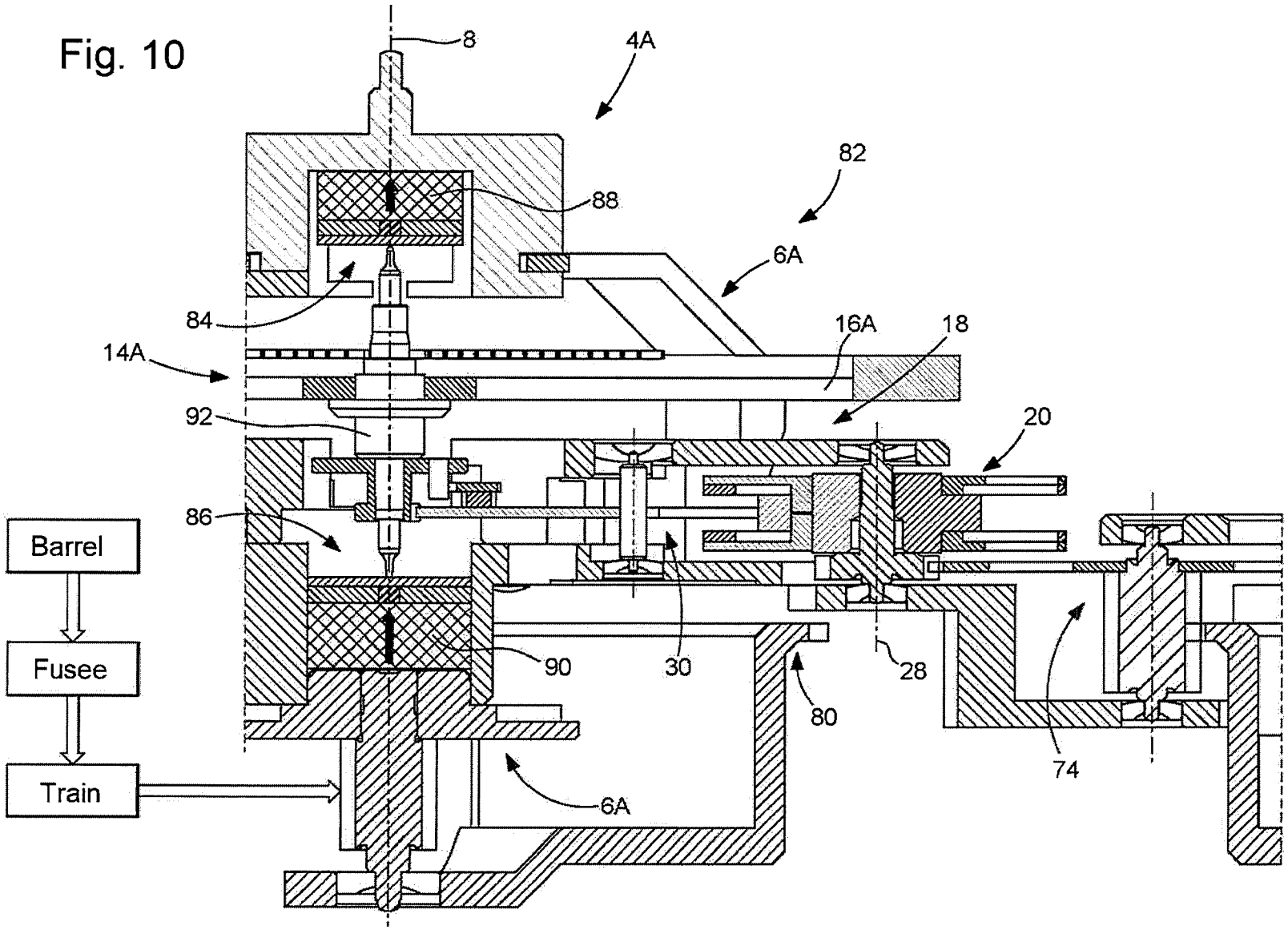
FIG. 10 is a partial cross-section, similar to that of FIG. 3, of a second embodiment of the invention.

FIG. 10 represents, in a cross-section similar to that of FIG. 3, a second embodiment of the invention. Only the distinctive elements of this second embodiment will be described hereinafter. It will be noted that the magnetic escapement is identical to that of the first embodiment and that all the variants described for this first embodiment also apply for the second embodiment, which is characterised by the arrangement of mechanical resonator 14A that comprises a balance 16A pivoted magnetically in carriage 6A of tourbillon 4A. The carriage comprises for this purpose two magnetic bearings 84 and 86 that are formed respectively of two magnets 88 and 90, arbor 92 of balance 16A being envisaged in ferromagnetic material to ensure the alignment thereof between the two magnets. For the operation of such a magnetic pivoting and various possible variants, reference may be made to documents EP 2 450 758, EP 3 109 712 and EP 3 106 933. Such a magnetic system for pivoting the balance in a tourbillon is remarkable in that it makes it possible to significantly reduce working differences between the horizontal positions and vertical positions of the movement, while the tourbillon makes it possible to average working differences between the various vertical positions.

Figure 11:
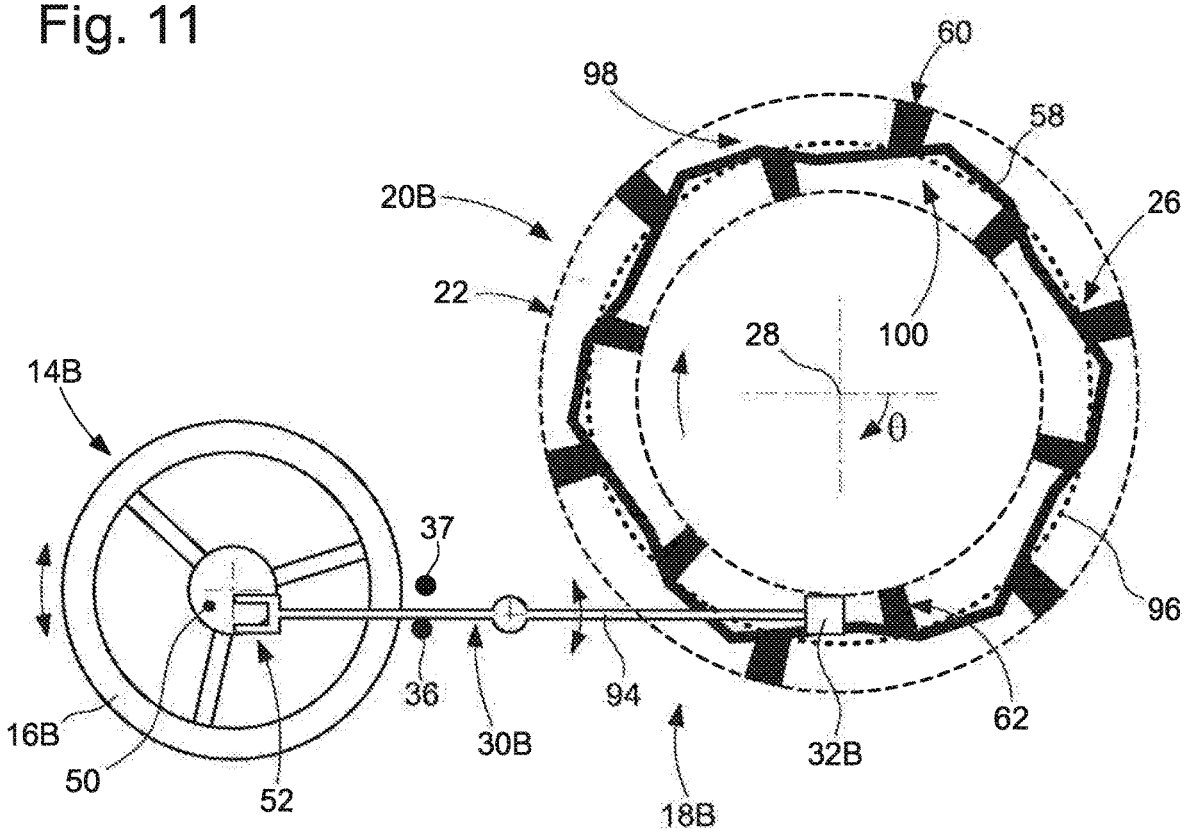
FIG. 11 is a partial schematic representation of a first variant of the first or second embodiment, wherein only the balance and the balance and the magnetic escapement incorporated in the tourbillon have been represented.

Two variants of the first and second embodiments will be described hereinafter. The first variant is represented in FIG. 11, in a simplified manner. Escapement device 18B comprises a pallet fork 30B and an escape wheel set 20B, formed of a single wheel 22 similar to that of the variants described above and therefore bearing a magnetic structure 26 that will not be described again herein. In FIG. 11 is represented median geometric circle 96 about which each energy impulse supplied to pallet fork 30B occurs, that transmits same to mechanical resonator 14B (wherein only balance 16A has been represented schematically). This median geometric circle 96 separates the re-entering portions from the entering portions of the magnetic track 58 and also outer stopping areas 60 from inner stopping areas 62, that form the magnetic barriers described above. More generally, this circle 96 separates two annular and contiguous magnetic tracks 98 and 100 facing which are located single magnetic element 32B of the pallet fork respectively in both rest positions of this pallet fork and therefore alternately during the successive magnetic potential energy accumulation phases in the magnetic escapement. The operation of this magnetic escapement is similar to that previously described. The main difference of this variant lies in pallet fork 30B that is fitted with a single magnet 32B, arranged repelling the magnetised magnetic structure 26, and in the escape wheel set that merely comprises a single magnetic structure arranged at a lower/higher level to that wherein the magnet oscillates when the timepiece movement is operating.

Figure 12:
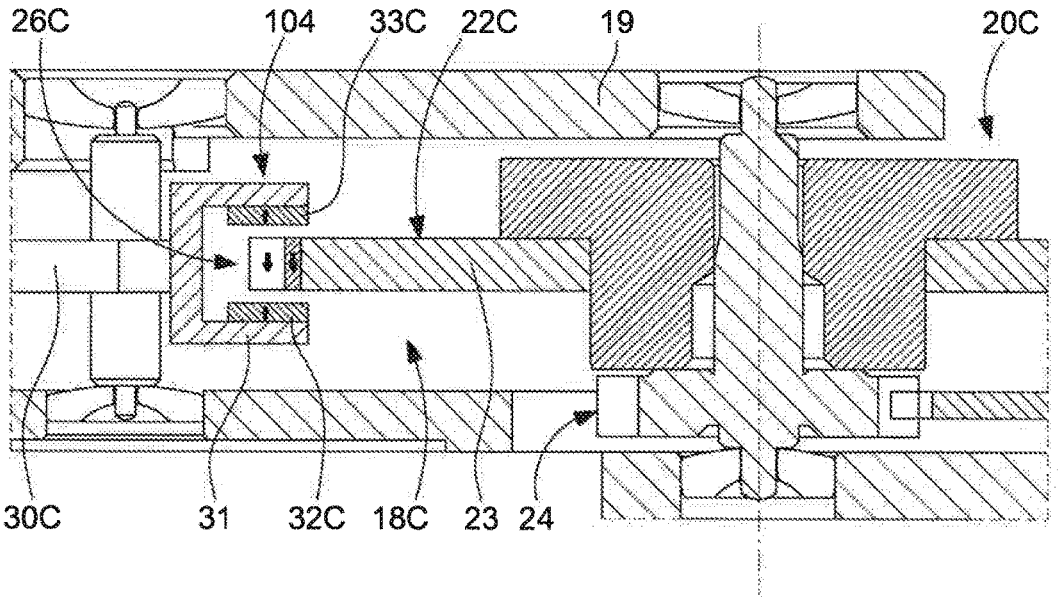
FIG. 12 shows a second variant of the first or second embodiment of the invention.

The variant in FIG. 12 is characterised by the material arrangement of various parts forming magnetic escapement 18C. However, the operation is similar to that previously described, magnetic structure 26C having in plan the same design as structure 26. Escape wheel set 20C and wheel 22C thereof, bearing magnetic structure 26C, differ respectively from wheel set 20B and from wheel 22 thereof in the preceding figure in that structure 26C extends laterally to a core 23, at the periphery thereof, while structure 26 is arranged on a support disc (optionally with high magnetic permeability according to the variant). Pallet fork 30C is, according to the variant, similar to pallet fork 30 or 30B, with the exception of the arrangement of the magnetic elements. More specifically, pallet fork 30C comprises at least one pair of similar magnetic elements 32C and 33C (two identical magnets in the example shown) that are situated respectively above and below magnetic structure 26C and that are both coupled in a similar manner with this magnetic structure and such that the magnetic couplings thereof are added together. Preferably, each pair of magnets is borne by a support 31 made of high magnetic permeability (particularly ferromagnetic) having a general 'C' shape.

Figure 13:
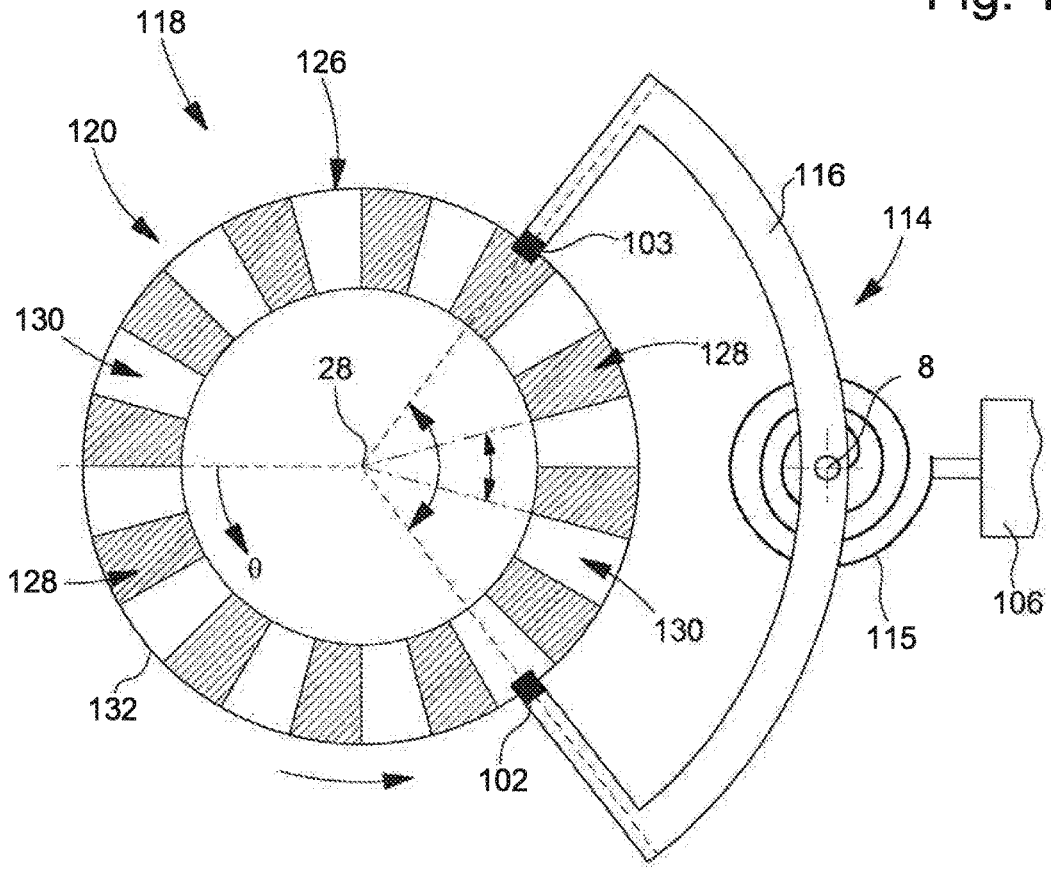
FIG. 13 shows the mechanical resonator and the magnetic escapement, borne by a tourbillon carriage, of a third embodiment of the invention.
Figure 14:
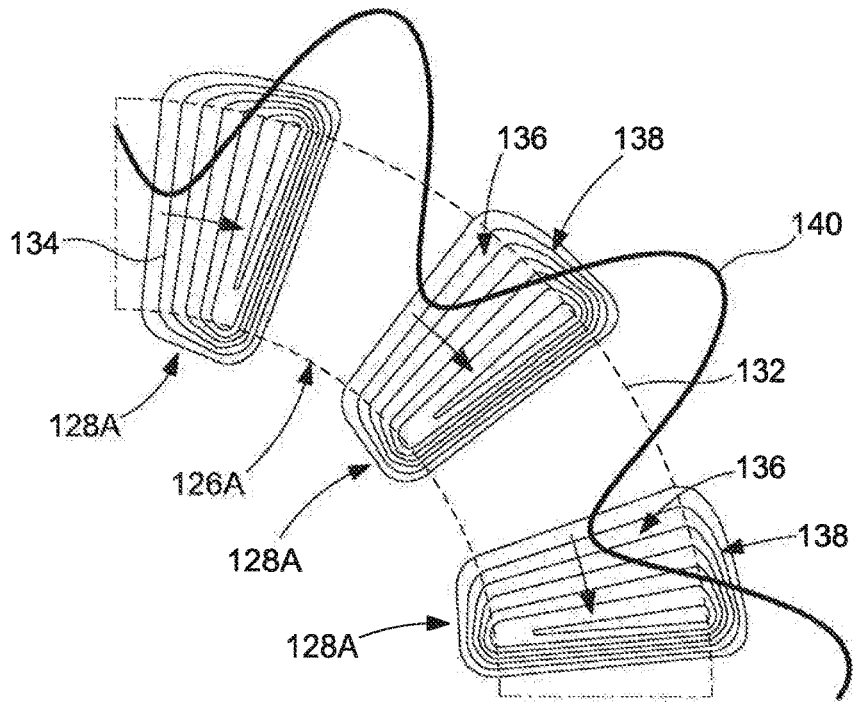
FIG. 14 represents, for the magnetic escapement of FIG. 13, magnetic potential energy curves defined by the magnetic structure and alternatively two magnetic elements attached to the balance and interacting with the magnetic structure.

With reference to FIGS. 13 and 14, there will be described hereinafter a third embodiment of the invention characterised by a magnetic escapement 118 with no stopper, escape wheel set 120 being directly coupled magnetically with mechanical resonator 114 (represented schematically) wherein balance 116 bears magnetic elements 102 and 103. The balance is associated with a sprung balance 115. Tourbillon carriage 106 is represented schematically by a unit to which is fastened one end of the sprung balance and that bears balance 116 and wheel set 120, which are arranged pivoting in carriage 106, respectively about two axes of rotation 8 and 28 as in the two preceding embodiments. Escape wheel set 120 rotates continuously and synchronously with the oscillation of the mechanical resonator (i.e. the escape wheel rotates by a predetermined angular period during each oscillation period of balance 116). It will be noted that the angular speed of the escape wheel set may exhibit a certain variation during each oscillation period, particularly depending on whether an energy accumulation phase or an energy transfer phase applies.

Magnetic structure 126 is annular and formed alternately of annular sectors 128, wherein are arranged magnets in magnetic repulsion with magnets 102 and 103 when they are presented alternately facing these annular sectors, and of annular sectors 130 formed of a non-magnetic material, such as brass or aluminium. Each pair of adjacent annular sectors defines an angular period of the magnetic structure. Preferably, the magnets of magnetic structure 126 have angularly an increasing thickness in the opposite direction of the direction of rotation envisaged for the escape wheel set, so as to have an air gap that decreases between each and magnet 102, 103 passing above (when the escape wheel set rotates) and also a magnetic flux that intensifies. For such an advantageous variant, FIG. 14 represents level curves 134 for the magnetic potential energy in the magnetic escapement (consisting herein of magnetic structure 126 and of the two magnets 102 and 103 secured to the balance) as a function of the relative angular position of one or the other of the two magnets 102 and 103. When mechanical resonator 114 oscillates, these two magnets oscillate with a phase shift of 180°, each along an outline represented by curve 140 in a polar coordinate system associated with the escape wheel set. Each annular sector 128 defines a set 128A of level curves, two successive sets 128A being separated by a sector 126A of zero magnetic potential energy defined by an annular sector 126. Level curves 134 are inwardly increasing, i.e. the outer curve has a lower potential energy than the next curve situated therein, and so on. For further variants, reference will be made to document EP 2 891 930 that describes magnetic escapements of the type selected within the scope of the third embodiment.

When the mechanical resonator is in the neutral position thereof (minimum mechanical energy position represented in FIG. 13), the two magnets 102, 103 are situated on a zero position circle 132. When the mechanical resonator oscillates, these magnets penetrate alternately above the magnetic structure such that the balance is constantly coupled magnetically with this magnetic structure. So that these two magnets experience alternately the same coupling with the magnetic structure, they have an angular phase shift of an odd number of angular half-periods of the magnetic structure. Thus, the escape wheel set rotates by a determined angular period at each oscillation period of the balance. Furthermore, in a similar manner to the preceding embodiments, the two magnets 102 and 103 are subjected essentially to a radial movement, relative to axis of rotation 28 of the escape wheel set, when the balance oscillates. Preferably, the movement thereof is oriented radially when they intersect zero position circle 132 (corresponding to the outer circle of the magnetic structure). As mentioned, in the variant proposed herein, the two magnets 102 and 103 are alternately coupled with the magnetic structure such that they are subjected successively to a magnetic coupling with one of the magnetised annular sectors 128. Thus, the overall magnetic potential energy in magnetic escapement 118 is given by level curves 134 in FIG. 14.

It is observed in FIG. 14 that the magnetic escapement is arranged so as to have, in normal timepiece movement operation, alternately energy accumulation phases, from a conversion of mechanical energy supplied by the barrel into magnetic potential energy in the magnetic escapement, and transfer phases of energy accumulated in the magnetic escapement to the magnetic resonator. The magnetic escapement defines rising angular magnetic potential energy accumulation gradients 136 to which are subjected, during the continuous rotation of the magnetic structure, alternately magnets 102 and 103 during successive energy accumulation phases during which they climb successively and partially these rising angular gradients. As the magnetic interaction force between magnets 102, 103 and the magnetic structure is oriented perpendicularly to level lines 134, these magnets are then subjected to a magnetic force which is essentially perpendicular to the radius formed thereby with axis of rotation 28. Thus, magnetic structure 126 (and therefore the escape wheel set) is subjected, during this energy accumulation phase, to a magnetic force torque, relative to the axis of rotation thereof, having an opposite direction to that of a drive torque, applied by the barrel via the tourbillon carriage to the escape wheel set. It will be noted that the arrangement of magnets 102, 103 and of magnetised annular sectors 128 is envisaged such that, in normal operating mode, the intensity of the magnetic force torque is less than that of the drive torque, such that the escape wheel set can continue the rotation thereof and rotate by a certain angle, thus enabling potential energy accumulation in the magnetic escapement.

The magnetic escapement also defines descending radial magnetic potential energy gradients 138 descended alternately by the two magnets 102 and 103 after having climbed respectively the rising angular gradients 136. As the magnetic force exerted on each magnet 102, 103, descending a descending radial gradient, is oriented perpendicularly to level lines 134, it is then subjected, during energy transfer phases, essentially a radial magnetic force, relative to axis of rotation 28, during each alternation of the oscillation movement of the mechanical resonator and in the direction of this oscillation movement during this alternation, such that the magnetic escapement then converts into mechanical energy magnetic potential energy accumulated in the preceding energy accumulation phase to be able to maintain the oscillation of the mechanical resonator. The decrease in magnetic potential energy in the magnetic escapement therefore results essentially from work of the radial magnetic force applied alternately on each of the two magnetic elements, this work of the radial magnetic force being transmitted directly to the mechanical resonator, such that this mechanical resonator receives a mechanical energy impulse in each alternation of the oscillation movement thereof.

The descending radial gradients 138 extend over a certain angular distance such that the continuous movement of the escape wheel has no repercussions in respect of the particular features sought within the scope of the present invention. Indeed, what is important is that the main radial force exerted alternately on each of the two magnets fastened to the balance is practically not dependent on any rotation of the escape wheel set. Indeed, it is observed in FIG. 14 that the arrangement of the magnetic structure makes it possible to generate energy impulses for the balance without rotation of the escape wheel set. If the latter stopped at the end of the energy accumulation phase, then the balance would receive nonetheless in impulse form the same quantity of energy as that received when subjected during the energy transfer phases to a certain rotational movement. Furthermore, it is observed that this quantity of energy remains quasi-constant, whether the angular speed of the balance is low or relatively high, for all that the magnetic escapement is arranged such that, in normal operation, it does not attain the peaks of the rising angular gradients 136 at the end of energy accumulation phases. This condition is envisaged in the magnetic escapement according to this third embodiment.

Finally, it will be noted that a fusee (similar to fusee 12 represented within the scope of the first embodiment) incorporated in the timepiece movement makes it possible to equalise the force torque supplied by the barrel to the tourbillon carriage, such that the escape wheel set is subjected to a constant torque during normal timepiece movement operation. Within the scope of the third embodiment, such a fusee makes it possible to obtain a stationary operating phase throughout the useful operating range of the timepiece movement, with the oscillation amplitude of the balance remaining constant and maintenance impulses supplying to the balance the same quantity of mechanical energy. All the benefit provided by a fusee for equalising the force torque in a conventional mechanical timepiece movement is provided to the timepiece according to this third embodiment.

The invention claimed is:

1. A timepiece comprising:

a timepiece movement fitted with a tourbillon comprising a carriage arranged rotating about a main axis, a barrel arranged to accumulate mechanical energy and a geartrain kinematically linking the tourbillon carriage to the barrel, the tourbillon bearing a mechanical resonator, formed of a balance and a balance-spring, and an escapement device; wherein the escapement device is a magnetic escapement that comprises an escape wheel set formed of an escape pinion and at least one magnetic structure, which has a general annular shape centred on an axis of rotation of the escape wheel set, said magnetic escapement further comprising a magnetic element or a plurality of magnetic elements, said magnetic element or each magnetic element being arranged so as to have an oscillating movement that is synchronous with the oscillation of the mechanical resonator and that has a radial component different to zero relative to said axis of rotation, said magnetic element being coupled with said at least one magnetic structure or each magnetic element of said plurality of magnetic elements being coupled, at least momentarily periodically, with said at least one magnetic structure such that the escape wheel set rotates by a predetermined angular period at each oscillation period of the balance; wherein the magnetic escapement is arranged so as to have, in normal timepiece movement operation, alternately energy accumulation phases, from a conversion of mechanical energy supplied by the barrel into magnetic potential energy in the magnetic escapement, and transfer phases of energy accumulated in the magnetic escapement to the magnetic resonator; and wherein the magnetic escapement is arranged such that:

during each energy accumulation phase, said at least one magnetic structure is subjected to a magnetic force torque, relative to said axis of rotation, having an opposite direction to that of a drive torque, applied by the barrel via the tourbillon carriage to the escape wheel set, and an intensity less than that of said drive torque, such that the escape wheel set rotates by a certain angle to enable the accumulation of a certain magnetic potential energy in the magnetic escapement;

during each transfer phase of energy, said magnetic element or each magnetic element of a set of magnetic elements, that of the plurality of magnetic elements was coupled with said at least one magnetic structure during a preceding energy accumulation phase, is subjected to a radial magnetic force, relative to said axis of rotation, during an alternation of the oscillating movement thereof and in the direction of the radial component of said oscillating movement during said alternation, such that the magnetic escapement then converts into mechanical energy magnetic potential energy accumulated in the preceding energy accumulation phase to be able to maintain the oscillation of the mechanical resonator, wherein the oscillation frequency of the mechanical resonator is substantially equal to or greater than six Hertz.

2. The timepiece according to claim 1, wherein said magnetic escapement comprises a stopper coupling momentarily, in each oscillation alternation of the mechanical resonator, said mechanical resonator with the escape wheel set, the stopper bearing said magnetic element or said plurality of magnetic elements and being subjected, when the mechanical resonator oscillates, to a to-and-fro movement interspersed with rest phases wherein the stopper is alternately stopped in two rest positions; wherein said at least one magnetic structure defines in the two rest positions of the stopper respectively a first magnetic potential energy curve and a second magnetic potential energy curve, both as a function of the angle of the escape wheel set and each having:

increasing portions for the magnetic interaction between said at least one magnetic structure and said magnetic element or a set of magnetic elements that, of the plurality of magnetic elements, are coupled with said at least one magnetic structure in a corresponding rest position of the stopper, these increasing portions being configured so as to be suitable for being climbed, during normal timepiece movement operation, by said magnetic element or by said set of magnetic elements, and magnetic barriers following respectively the increasing portions, said magnetic barriers being arranged so as to be suitable for stopping angular progress of the escape wheel set while the stopper is in the corresponding rest position;

said increasing portions of the first magnetic potential energy curve being respectively offset angularly relative to the increasing portions of the second magnetic potential energy curve, each magnetic barrier of one of the first and second magnetic potential energy curves being situated angularly between two successive magnetic barriers of the other of these first and second magnetic potential energy curves; the magnetic escapement being arranged such that:

the energy accumulation phases occur essentially and respectively in the successive rest phases of the stopper, during each energy accumulation phase, said magnetic element or a set of magnetic elements, which of said plurality of magnetic elements are at that time coupled with said at least one magnetic structure, is suitable for climbing at least partially one of the increasing portions during a certain rotation of the escape wheel set, the increasing portions of the first and second magnetic potential energy curves may, during said normal timepiece movement operation, be respectively and alternately climbed at least partially during successive energy accumulation phases;

and wherein the magnetic escapement is further arranged such that:

the transfer phases of energy occur respectively in successive alternations of the to-and-fro movement of the stopper, said magnetic escapement is subjected, during said normal timepiece movement operation, overall to a decrease in magnetic potential energy during each of the successive alternations of the to-and-fro movement of the stopper, and the decrease in magnetic potential energy in the magnetic escapement results essentially from work of said radial magnetic force applied on said magnetic element or on each magnetic element of a set of magnetic elements that, of the plurality of magnetic elements, were coupled with said at least one magnetic structure during a preceding rest phase, said work of the radial magnetic force thus being supplied to the stopper that is arranged to transmit same mostly to the mechanical resonator, such that said mechanical resonator can receive a mechanical energy impulse in each alternation of the to-and-fro movement of said stopper.

3. The timepiece according to claim 2, wherein the tourbillon further bears an intermediate wheel set of which an intermediate wheel meshes with the escape pinion and an intermediate pinion meshes with a fixed second wheel comprised by the timepiece movement, the intermediate wheel set being a reducer wheel set of the rotational frequency of the escape wheel set and being arranged such that said tourbillon carriage performs one revolution on itself per minute.

4. The timepiece according to claim 3, wherein the oscillation frequency of the mechanical resonator has a value situated between, inclusive, eight Hertz and twelve Hertz.

5. The timepiece according to claim 3, wherein the rotational frequency of the escape wheel set has a value between, inclusive, one quarter and one sixteenth of the oscillation frequency of the mechanical resonator.

6. The timepiece according to claim 1, wherein the magnetic escapement comprises at least two similar magnetic elements that are situated on the same side of said magnetic structure and that are both coupled simultaneously with said magnetic structure such that the respective magnetic couplings thereof are added together.

7. The timepiece according to claim 1, wherein the magnetic escapement comprises at least one pair of similar magnetic elements that are situated respectively above and below said magnetic structure and that are both coupled simultaneously with said magnetic structure such that the respective magnetic couplings thereof are added together.

8. The timepiece according to claim 1, wherein said magnetic structure is a first magnetic structure; and wherein the escape wheel set comprises a second magnetic structure that has a planar symmetry with the first magnetic structure and that is situated at a distance therefrom so as to enable said magnetic element or each magnetic element of said plurality of magnetic elements to be situated, during said oscillating movement, at least momentarily between the first and second magnetic structures.

9. The timepiece according to claim 8, wherein the first magnetic structure and the second magnetic structure are formed respectively of a first permanent magnet and a second permanent magnet that each have an axial magnetisation and the same polarity; and wherein said magnetic element or each magnetic element of said plurality of magnetic elements is formed of a permanent magnet having an axial magnetisation and an inverted polarity relative to the first and second magnetic structures, so as to be subjected to a magnetic repulsion force with each of the two magnetic structures.

10. The timepiece according to claim 9, wherein said escape wheel set bears a first ferromagnetic structure and a second ferromagnetic structure covering respectively the first and second magnetic structures of both external sides of the set of these first and second magnetic structures, so as to form thus a shield of the first and second magnetic structures and of each magnetic element when the latter is situated therebetween and is thus coupled magnetically therewith.

11. The timepiece according to claim 1, wherein the balance is pivoted magnetically in the carriage of the tourbillon that comprises for said purpose two magnetic bearings.

12. The timepiece according to claim 1, wherein the magnetic element of the magnetic escapement is a single magnet arranged to repel said at least one magnetic structure.

13. The timepiece according to claim 1, wherein said at least one magnetic structure of the escapement device is a single magnetic structure that extends laterally from a core and the magnetic escapement comprises at least one pair of similar magnetic elements that are situated respectively above and below said single magnetic structure and that are both coupled simultaneously with said single magnetic structure such that the respective magnetic couplings thereof are added together.

* * * * *